United States Patent [19]

Grushkin

[11] Patent Number: 4,542,898

[45] **Date of Patent: * Sep. 24, 1985**

[54] COMBINATION MANUALLY AND INERTIA PROPELLED SKI-MOTION EXERCISE MACHINE

[76] Inventor: Harold Grushkin, 25 Atlantic Ave., Nanuet, N.Y. 10954

[ * ] Notice: The portion of the term of this patent subsequent to Sep. 24, 2000 has been disclaimed.

[21] Appl. No.: 308,839

[22] Filed: Oct. 5, 1981

[51] Int. Cl.[4] ..... A63B 69/18

[52] U.S. Cl. ..... 272/97; 272/126

[58] Field of Search ..... 272/97, 126, 130; 434/253; 128/25 R, 25 B

[56] References Cited

U.S. PATENT DOCUMENTS

| | | | |
|---|---|---|---|
| 2,274,081 | 2/1942 | Mautin | 272/97 |
| 2,455,274 | 11/1948 | Scriver | 272/97 |
| 3,112,108 | 11/1963 | Hanke | 272/126 X |
| 3,731,919 | 5/1973 | Schurch | 272/97 |
| 3,912,260 | 10/1975 | Rice | 272/97 |
| 4,007,927 | 2/1977 | Proctor | 128/25 R X |
| 4,340,214 | 7/1982 | Schützer | 272/97 X |

FOREIGN PATENT DOCUMENTS

| | | | |
|---|---|---|---|
| 80031 | 3/1895 | Fed. Rep. of Germany | 128/25 R |
| 8003104 | 12/1980 | Netherlands | 272/130 |

*Primary Examiner*—William H. Grieb

[57] ABSTRACT

This machine is manually and inertia operated, the movement of the use being like that of a skier traveling down a typical ski-slope. It contains primarily of a vertical and rectangular frame, having a board pivotal on the top in a see-saw like fashion by the user. It further includes roller mounted footrests, and a connecting rod is secured to the board and is secured to a crank arm and sprocket, which by a chain, drives a second sprocket attached to a flywheel, which will cause the ski-motion to continue, after a few applied motions of the user to the board of the machine.

8 Claims, 3 Drawing Figures

COMBINATION MANUALLY AND INERTIA PROPELLED SKI-MOTION EXERCISE MACHINE

This invention relates to exercise devices, and more particularly, to a combination manually and enertia propelled ski-motion excercise machine.

It is therefore the principal object of this invention to provide a combination manually and enertia propelled ski-motion excercise machine, which will be unique and novel, as excercise means for the user's feet, legs, hips, abdomen, etc.

Another object of this invention is to provide a combination manually and enertia propelled ski-motion excercise machine, which simulates the body and leg motions of a skier, as he or she descends a typical ski-slope.

Another object of the invention is to provide a combination manually and enertia propelled ski-motion excercise machine, which will automatically continue the first several manually initiated movements, by flywheel enertia means.

A further object of this invention is to provide a combination manually and enertia propelled ski-motion excercise machine, which may be adapted to operate by electric motor means, so as to eliminate any effort on the part of the user, while still excercising the user's heretofore described portions of the body.

A still further object of this invention is to provide a combination manually and enertia propelled ski-motion excercise machine, which will be safe in operation.

Other objects of the invention, are to provide a combination manually and enertia propelled ski-motion machine, which will be simple in design, inexpensive to manufacture, rugged in construction, and easy to use.

These and other objects, will become readily evident, upon a study of the following specification and the accompanying drawing, in which.

Figure 1:
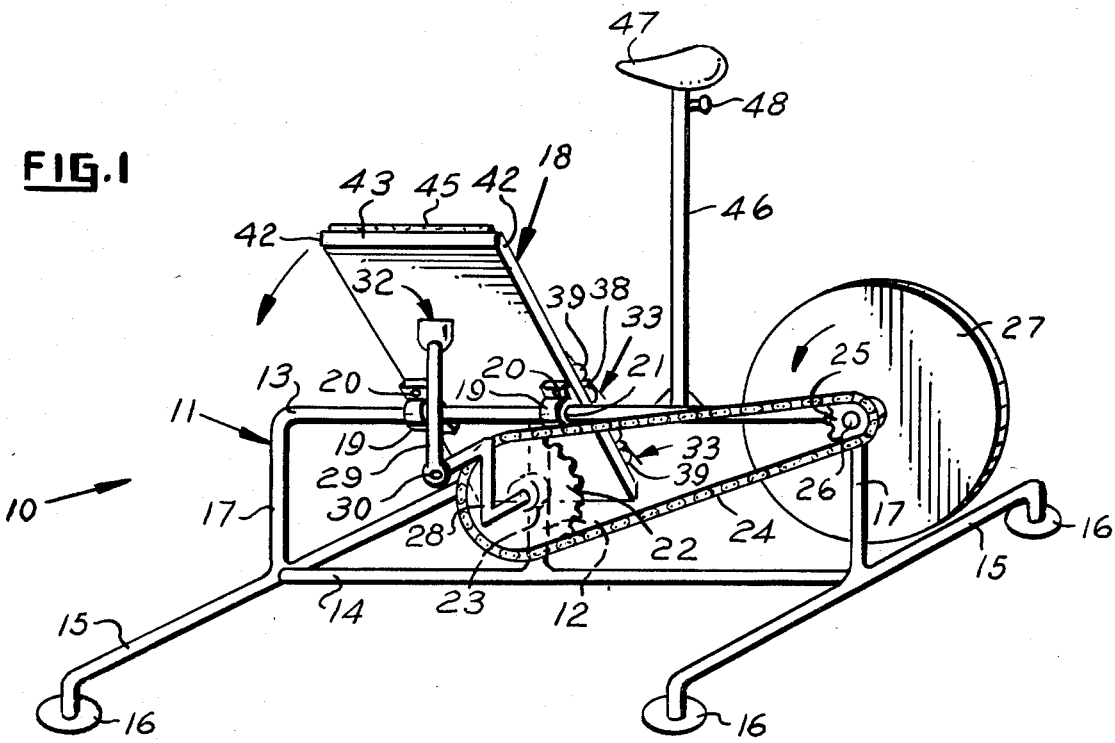
FIG. 1 is a perspective view of the present invention.
Figure 3:
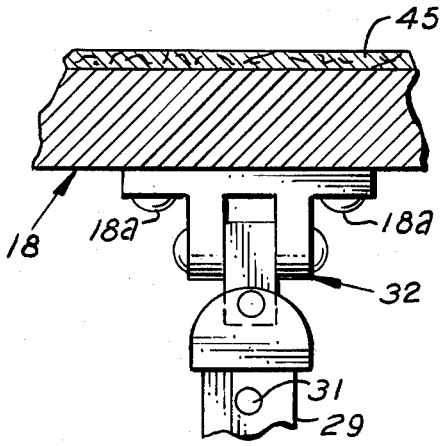
FIG. 3 is an enlarged cross-sectional view of the board of FIG. 1, showing the universal mounting means to the connecting rod of the crank arm, which is uncovered.

According to this invention, a machine 10 is shown to include a tubular and rectangularly configurated frame 11, which includes a vertical member 12, fixedly secured to and between the upper horizontal and the lower horizontal members 13 and 14, by welding or other suitable means. A pair of tubular and "V"-shaped leg members 15, with footrests 16, are secured by welding or other means, to the bottom ends of the vertical end 17 portions of frame 11, so as to provide lateral stabilization and support means for frame 11 of machine 10. A pivatal board 18 is secured to the upper horizontal member 13, by means of a pair of spaced apart bearing members 19, which are secured to the underside of board 18, by means of suitable fasteners 20. The bearing members 19 are freely and rotatably received on member 13 of frame 11, and a suitable pin 21 is secured transversely through member 13, on each side of bearing members 19, so as to prevent any forward or aft movement of the board 18 on member 13, when machine 10 is in operation.

A sprocket 22 is rotatably received against a hub 23, which incudes a bearing, not shown, and hub 23 is fixedly secured to one side of vertical member 12, in a suitable mannner. An endless chain 24 is received on sprocket 22 and on sprocket 25, which is suitably fastened to a shaft 26, which is journaled in a bearing, not shown, and shaft 26 is fastened to a flywheel 27 in a manner known in the art, the flywheel 27 being rotatable, by means of the sprockets 22 and 25, through chain 24, when machine 10 is in operation. Sprocket 22 is fixedly secured to a crank arm 28 in a suitable manner, and crank arm 28 is rotatably secured at one end, in vertical member 12 by suitable means, and is rotatable in hub 23. The opposite end of crank arm 28 is pivotally secured to one end of connecting rod 29, by means of a suitable pivotal fastener 30. The opposite end of connecting rod 29 is connected by pin 31 means, to a universal joint 32, which is fixedly secured to the underside of board 18 by fasteners 18*a*, and the user's feet are used in a manner, which hereinafter will be described, to pivot board 18, which will rotate sprocket 22, so as to rotate flywheel 27, through sprocket 25 and chain 24 means.

Figure 2:
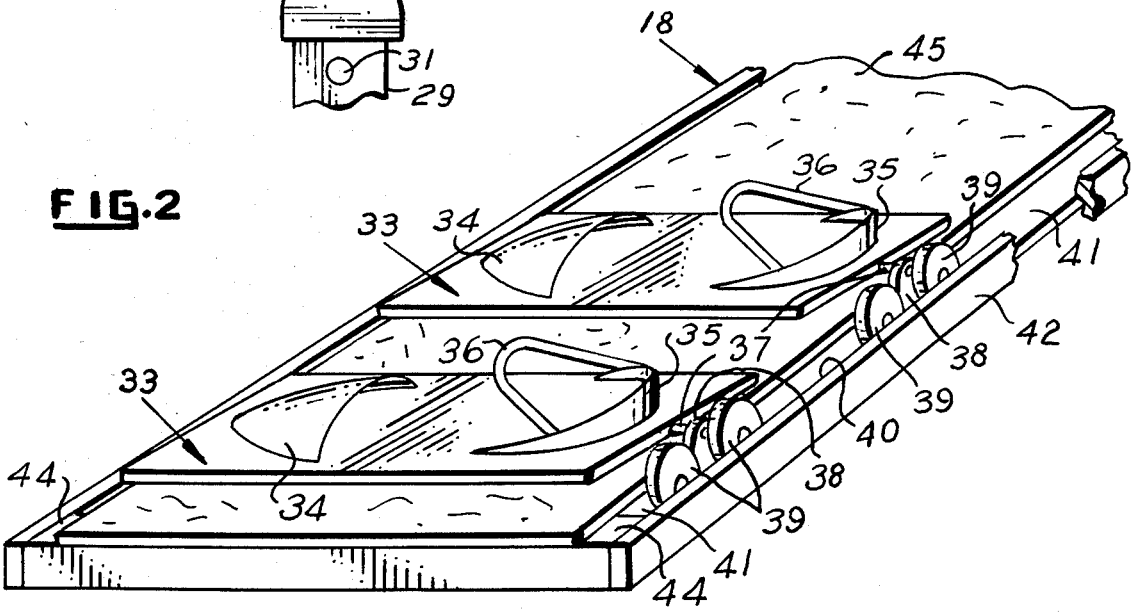
FIG. 2 is an enlarged fragmentary perspective view of the pivotal board, shown partly broken away and removed from FIG. 1.

Referring now, more particularly to FIG. 2 of the drawing, the board 18, which moves in see-saw fashion when machine 10 is in use, is shown to include a pair of pivotal footrest members 33 of rectangular configuration, which have compartment 34 means, for the placement of the toe portion of one of the user's feet. Compartments 34 are fixedly secured to the tops of their respective footrest members 33, and are spaced apart from a heel receiving member 35, which is fixedly secured to footrest members 33 in a suitable manner, and members 35 include an ankle strap 36 of a suitable design, common the the art, for retaining a person's feet in the members 34 and 35, when 10 is in use. A pin 37, only two of which are shown, are fixedly secured in a suitable manner, in the center of the ends of footrest members 33, and each are pivotally secured in the top portion of a truck member 38. A pair of spaced apart rollers 39 are rotatably received on each of the truck members 38, and are freely received in the track grooves 40, which are defined by the sides 41 of board 18, and the side rails 42, the side rails 42 being fixedly secured to the ends 43 of board 18 by suitable fastening means. A projection 44 extending from each corner of board 18, serves as stop means for the wheels or rollers 39, to prevent footrest members 33 from accidently coming off the ends 43 of board 18, and a carpet 45 is adhered to the top of board 18 in a suitable manner. A seat post 46 of tubular structure, is fixedly secured at one end, to the top of member 13 in a suitable manner, and the seat 47 is adjustable in height, by set screw 48 means, so as to adapt machine 10 to persons of various heights.

In operation, the user sits upon the seat 47 and places his or her feet in the members 34 and 35 of the footrest members 33. The user then starts the ski-motion, by leaning his upper torso to the right or left, and urges his feet in the opposite direction, which by urging his legs downward, will cause the footrests 33 to travel towards the end 43 of board 18 in the direction opposite of the direction the user's upper torso is leaned. The above mentioned motion, causes that end 43 of the board 18, to pivot laterally downwards about the longitudinal axis of the upper member 13 of frame 11, and when the rollers 39 reach the projections 44, they will serve as stop means, limiting any further travel of the rollers 39. When the above motion is occuring, the connecting rod 20, in a reciprocating motion, will rotate the crank arm 28, which will rotate sprocket 22. When sprocket 22 rotates, chain 24 drives sprocket 25, thus rotating flywheel 27, which by enertia means, tends to continue the see-saw like motion of board 18. When the user reverses his upper torso motion to the opposite side, and simultaneously moves his legs in the opposite direction, which will move the footrest members 33 to the opposite end 43 of board 18 by their rollers 39, board 18 will pivot downward to the opposite side of frame 11, and crank arm 28 will have rotated three hundred and sixty degrees. As the ski-motion continues several times by the user's motion, energy will build-up in the flywheel 27, as is a known principle or physics, and thus, the flywheel 27 will cause the side to side ski-motion to continue without any effort upon the user, until it stops or winds down by friction means.

It shall be noted, that suitable braking means may be employed in the structure of machine 10, so as to brake the flywheel 27 when necessary, such as, when the user does not want to wait for the normal run-down of the energy created by the enertia of the flywheel 27.

It shall also be recognized, that a smaller diameter and thicker flywheel 27 may be employed, to provide the same amount of energy to propel machine 10, if desired, and a plurality of machines 10, may be suitably coupled together and be motor operated.

While various changes may be made in the detailed structure, such changes will be within the spirit and scope of the present invention, as is defined by the appended claims.

I claim:

1. A combination manually and enertia propelled ski-motion excercise machine, comprising, in combination, a rectangular frame, a pair of legs secured to said frame, providing lateral stabilizing and support means for said frame, a seat and post secured to said frame, for the user to sit upon, a pivotal board secured to said frame, with footrest members for the users feet to operate said machine, a pair of sprockets with chain means secured to said frame, for rotating a flywheel, which stores energy for continuing the pivoting motion of said board after said machine is operated several revolutions of said pair of sprockets, said flywheel, and crank means, that are secured to said frame.

2. The combination according to claim 1, wherein said board is secured above the upper longitudinal portion of said frame by a pair of spaced apart bearing members, which are fixedly secured to the bottom of said board by suitable fasteners, and said upper portion of said frame is freely and rotatably received in said bearing members, so as to enable said board to be pivotal laterally about the longitudinal axis of said upper portion of said frame.

3. The combination according to claim 2, wherein a plurality of suitable pins are fixedly secured, transversely through said upper portion of said frame in a suitable manner, and are adjacent to each side of said bearing members, so as to prevent forward and aft sliding of said board when said machine is in operation.

4. The combination according to claim 3, wherein said crank means comprises a connecting rod secured at one end, to a universal joint member, which is fixedly secured to the bottom of one side portion of said board by suitable fasteners, and the opposite end of said connecting rod is pivotally secured by pivot pin means, to one end of a crank arm, and the opposite end of said crank arm is rotatably received in a bearing containing hub and a vertical tube, which is fixedly secured to and between said upper longitudinal and the lower longitudinal portion of said frame.

5. The combination according to claim 4, wherein said opposite end of said crank arm is fixedly secured in one of said sprockets, which includes said chain means that is received on the other of said sprockets, and said other of said sprockets is secured to a shaft rotatably secured by suitable means, to a hub fixedly secured in a suitable manner to the upper rear corner of said frame, and said flywheel is secured stationary to said shaft by suitable fastening means, so as to be rotated by said crank means, when said board is pivoted from side to side on said frame by said use.

6. The combination according to claim 5, wherein said footrest members are a pair, which are spaced above said board, and each includes a projecting central pin, fixedly secured in each end by suitable means, and each of said pins is rotatably secured in the center upper portion of a truck member, which supports said footrest members above said board, by roller means.

7. The combination according to claim 6, wherein said roller means are a pair, secured spaced apart to each of said truck members by pin means, and said roller means are in engagement with the bottom of a groove extending along the longitudinal sides of the top of said board, and a projection on each corner of said board, provides stop means for said rollers, so as to prevent said footrest members from leaving said board.

8. The combination according to claim 7, wherein said footrest members are tiltable, laterally by said pin means, so as to enable said user to keep his feet comfortable in a toe and heel receiving member, which is fixedly secured to the top surface of each said footrests.

* * * * *